US007753760B2

(12) United States Patent
Petrosky

(10) Patent No.: US 7,753,760 B2
(45) Date of Patent: Jul. 13, 2010

(54) APPARATUS AND METHOD FOR POLISHING DRILL BITS

(75) Inventor: Charles J. Petrosky, Greensburg, PA (US)

(73) Assignee: Kennametal Inc., Latrobe, PA (US)

( * ) Notice: Subject to any disclaimer, the term of this patent is extended or adjusted under 35 U.S.C. 154(b) by 1 day.

(21) Appl. No.: 12/098,686

(22) Filed: Apr. 7, 2008

(65) Prior Publication Data

US 2009/0253356 A1 Oct. 8, 2009

(51) Int. Cl.
*B24B 1/00* (2006.01)

(52) U.S. Cl. ..... 451/36; 451/48; 451/59; 451/104; 451/106

(58) Field of Classification Search ..... 451/36, 451/59, 60, 66, 103, 104, 106
See application file for complete search history.

(56) References Cited

U.S. PATENT DOCUMENTS

| | | | | |
|---|---|---|---|---|
| 1,717,554 | A * | 6/1929 | Fraser | 451/180 |
| 2,497,021 | A * | 2/1950 | Sterns | 451/36 |
| 3,623,278 | A * | 11/1971 | Schwartz | 451/32 |
| 4,641,463 | A * | 2/1987 | Bianco | 451/113 |
| 4,936,057 | A | 6/1990 | Rhoades | |
| 5,070,652 | A | 12/1991 | Rhoades et al. | |
| 5,125,191 | A * | 6/1992 | Rhoades | 451/36 |
| 5,367,833 | A | 11/1994 | Rhoades et al. | |
| 5,762,538 | A | 6/1998 | Shaffer | |
| 6,273,787 | B1 * | 8/2001 | Gilmore et al. | 451/36 |
| 6,764,384 | B1 | 7/2004 | Kleer et al. | |
| 6,905,395 | B2 * | 6/2005 | Walch | 451/36 |
| 7,063,594 | B1 * | 6/2006 | Engin et al. | 451/36 |
| 7,217,173 | B1 * | 5/2007 | Yan et al. | 451/36 |
| 2004/0266320 | A1 * | 12/2004 | Walch | 451/36 |
| 2006/0234881 | A1 | 10/2006 | Leeb et al. | |

FOREIGN PATENT DOCUMENTS

| | | | |
|---|---|---|---|
| JP | 60080557 | A | 5/1985 |

* cited by examiner

*Primary Examiner*—Maurina Rachuba
(74) *Attorney, Agent, or Firm*—Larry R. Meenan

(57) ABSTRACT

A finishing device for finishing the exterior, flutes and tip of a drill bit is disclosed. The finishing device includes a containment vessel which houses an abrasive media which may have a visco-elastic component and an abrasive component. The drill bit is inserted into or through the abrasive media and rotated. A rotary member may be connected to the shank of the drill bit to provide rotation of the drill bit. The drill bit displaces the abrasive media thereby finishing the exterior, flutes, cutting edges and tip of the drill bit.

11 Claims, 4 Drawing Sheets

APPARATUS AND METHOD FOR POLISHING DRILL BITS

FIELD OF THE INVENTION

The present invention relates to devices and methods for finishing rotary tools. In particular, the present invention relates to devices and methods for polishing and honing drill bits.

BACKGROUND INFORMATION

Newly ground cutting tools, such as drill bits, often have cutting edges that are very sharp which tend to rapidly wear and/or weaken at the tips leading to failure. Honing or polishing is a final finishing operation conducted on cutting tools. Honing or polishing is a surface finish operation, not a gross geometry modifying operation.

As used herein, "finishing" may include polishing and honing. As used herein, "polishing" refers to the act of removing irregularities from the surface of a part. As used herein, "honing" refers to the rounding of a cutting edge to strengthen and smooth the edge surface.

Many drill bit finishing operations utilize brushes or abrasive stones to finish the bits. These processes take many steps to complete and are generally inefficient and expensive. Moreover, brush and stone processes are not well suited to produce precision instruments.

In response to these deficiencies, other finishing methods have evolved including abrasive fluid sprays, electrochemical deburring methods and tumbling techniques. However, most of these methods are either time consuming and expensive, difficult to perform and control, or fail to ensure consistent and repeatable results.

Abrasive flow machining (AFM) is a well known nontraditional machining process whereby a visco-elastic medium, permeated with an abrasive grit, is extruded through or past a workpiece surface to affect an abrasive working of that surface. The abrasive action in abrasive flow machining can be thought of as analogous to a filing, grinding, lapping or honing operation where an extruded visco-elastic abrasive medium passes through or past the workpiece as a "plug." The plug then becomes a self forming file, grinding stone or lap as it is extruded under pressure through the confined passageway restricting its flow, thereby working the selected surfaces of the workpiece. The typical AFM process (two-way flow) uses two vertically opposed cylinders which extrude an abrasive media back and forth through passages formed by the workpiece and tooling. Abrasive action occurs wherever the media enters and passes through the most restrictive passages. The extrusion pressure is controlled, as well as the displacement per stroke and the number of reciprocating cycles.

One-way AFM systems use a cylinder to flow the abrasive media through the workpiece in only one direction, allowing the media to exit freely from the part for fast processing, easy cleaning and simple quick-exchange tooling.

The present invention has been developed in view of the foregoing.

SUMMARY OF THE INVENTION

The present invention provides a finishing device for finishing the exterior, flutes and tip of a drill bit. The finishing device includes a containment vessel which houses an abrasive media which may have a visco-elastic component and an abrasive component. The drill bit is inserted into or through the abrasive media and rotated. A rotary member may be connected to the shank of the drill bit to provide rotation of the drill bit. The drill bit displaces the abrasive media thereby finishing the exterior, flutes, cutting edges and tip of the drill bit.

An aspect of the present invention provides a drill bit finishing device comprising a containment vessel having at least a first opening for receiving and securing the shank of a drill bit, the containment vessel defining a chamber, a pressurized abrasive media at least partially filling the chamber of the containment vessel and a rotary member which attaches to a shank end of the drill and rotates the drill to displace the abrasive media.

Another aspect of the present invention provides a drill bit finishing apparatus comprising a containment vessel having an opening for receiving a drill bit, the containment vessel defining a chamber, an abrasive media at least partially filling the chamber of the containment vessel and a rotary member which attaches to a shank end of the drill bit and rotates the drill bit in the abrasive media, wherein axial movement of the drill relative to containment vessel causes displacement of the abrasive media between the opening and the drill bit.

Another aspect of the present invention provides a method of finishing a drill bit comprising the steps of providing a containment vessel having a first opening for securing a tip of a drill bit and a second opening for securing a shank of a drill bit, whereby the drill bit passes through an internal chamber of the containment vessel, inserting the drill bit having at least one flute through the first and second opening of the containment vessel, filling the internal chamber of the containment vessel with an abrasive media, pressurizing the abrasive media and rotating the drill bit to displace the abrasive media thereby finishing the at least one flute of the drill bit.

Yet another aspect of a method of finishing a drill bit comprising the steps of providing a containment vessel having a first opening for securing a shank of a drill bit, whereby the drill bit extends into an internal chamber of the containment vessel, filling the internal chamber of the containment vessel with an abrasive media and inserting at least a tip of the drill bit into the containment vessel while rotating the drill bit, thereby displacing the abrasive media and finishing the tip of the drill bit.

DETAILED DESCRIPTION

For purposes of the following detailed description, it is to be understood that the invention may assume various alternative variations and step sequences, except where expressly specified to the contrary. Moreover, other than in any operating examples, or where otherwise indicated, all numbers expressing, for example, quantities of ingredients used in the specification and claims are to be understood as being modified in all instances by the term "about." Accordingly, unless indicated to the contrary, the numerical parameters set forth in the following specification and attached claims are approximations that may vary depending upon the desired properties to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances.

Figure 1:
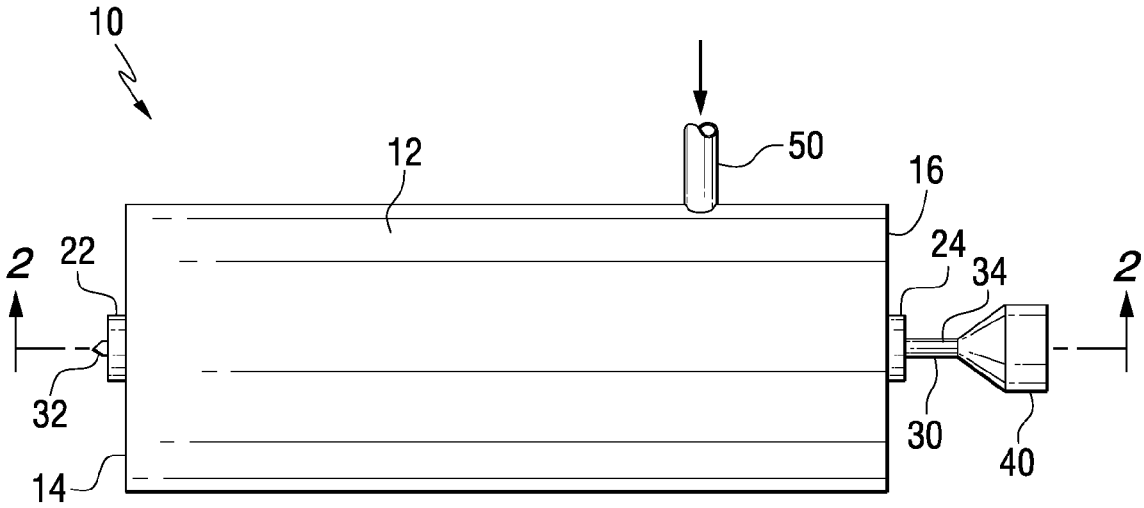
FIG. 1 is a side view of a drill bit polishing device with a drill bit installed and connected to a rotary member according to one embodiment of the present invention.

Referring now to FIG. 1, a drill bit polishing device 10 according to one embodiment of the present invention is shown. The polishing device 10 includes a containment vessel 12 having a tip end 14 and a shank end 16. A tip bushing 22 is located at the tip end 14 of the containment vessel 12. A shank bushing 24 is located on the exterior of the containment vessel on the shank end 16 at a position opposite the tip bushing 22.

Figure 2:
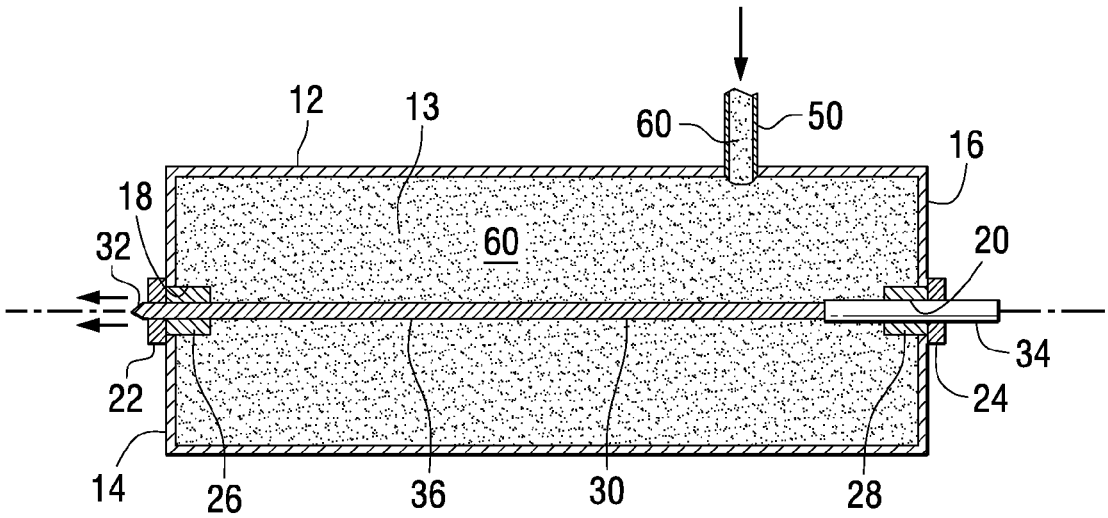
FIG. 2 is a longitudinal, cross-sectional view of the drill bit polishing device of FIG. 1 with the rotary member removed.

FIG. 2 is a cross-sectional view of the polishing device 10 of FIG. 1. A tip collar 26 is located just inside the containment vessel 12. The tip collar 26 is aligned with the tip bushing 22. Tip collar 22 and tip bushing 26, when aligned, share a common central tip bore 18 which secures the tip 32 of a drill bit 30. A shank collar 28 is located inside the containment vessel 12 at the shank end 16 and is aligned with the shank bushing 24 which is positioned on the exterior of the containment vessel 12. The shank bushing 24 and shank collar 28 shape a central shank bore 20 which secures the shank 34 of the drill bit 30.

As best seen in FIG. 2, the tip 32 of the drill bit 30 passes through the central bore 18 of the tip bushing 22 and tip collar 26. The drill bit 30 is held in axial and radial position by the tip bushing 22 and tip collar 26. The shank 34 of the drill bit 30 is held by a shank bore 20 of the shank bushing 24 and shank collar 28. Accordingly, drill bit 30 is situated about a longitudinal rotational axis 2. Drill bit 30 is held fixedly in place by the bushings 22, 24 and collars 26, 28, yet is permitted to rotate within these fixtures. In one embodiment, the collars 26, 28 comprise a wear-resistant material. In another embodiment, the collars 26, 28 further comprise a roller or ball bearing to promote free rotation of the drill bit 30.

The containment vessel 12 defines an internal chamber 13 which contains an abrasive media 60 which is defined in more detail below. Abrasive media 60 is fed into the containment vessel 12 through an inlet 50 attached to the containment vessel 12. The inlet 50 is in fluid communication with the chamber 13 of the containment vessel 12 at one end and at its other end, it is connected to an abrasive media pump (not shown) or other means of pressurizing the abrasive media 60. In one embodiment, the abrasive media pump is a hydraulic cylinder. The abrasive media pump is used to maintain the abrasive media at a positive pressure. The positive pressure of the abrasive media 16 may be about 50 pounds per square inch (p.s.i) to about 600 p.s.i., for example 400 p.s.i. Tip collar 26 may be in fluid communication with the abrasive media pump to return the abrasive media to the inlet or the abrasive media may be collected at the tip collar 26 and processed in some other manner.

Referring again to FIG. 1, the shank 34 of the drill 30 may be connected to a rotary member 40. Rotary member 40 may be a collar, a spindle, collet, toolholder or other fastening device connected to a rotating motor or gear or some other apparatus capable of attaching to the shank 34 and rotating the drill bit 30 about the rotational axis 2.

Figure 3:
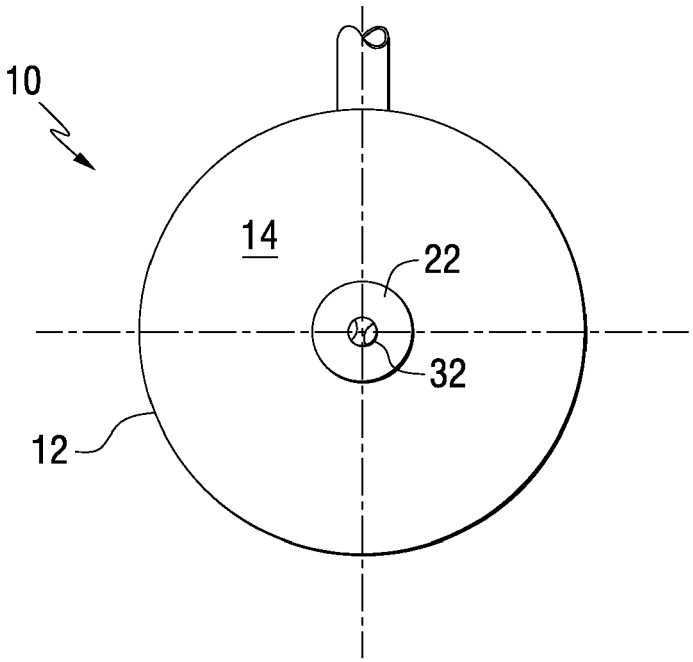
FIG. 3 is a view of the tip end of the drill polishing device of FIG. 1.
Figure 4:
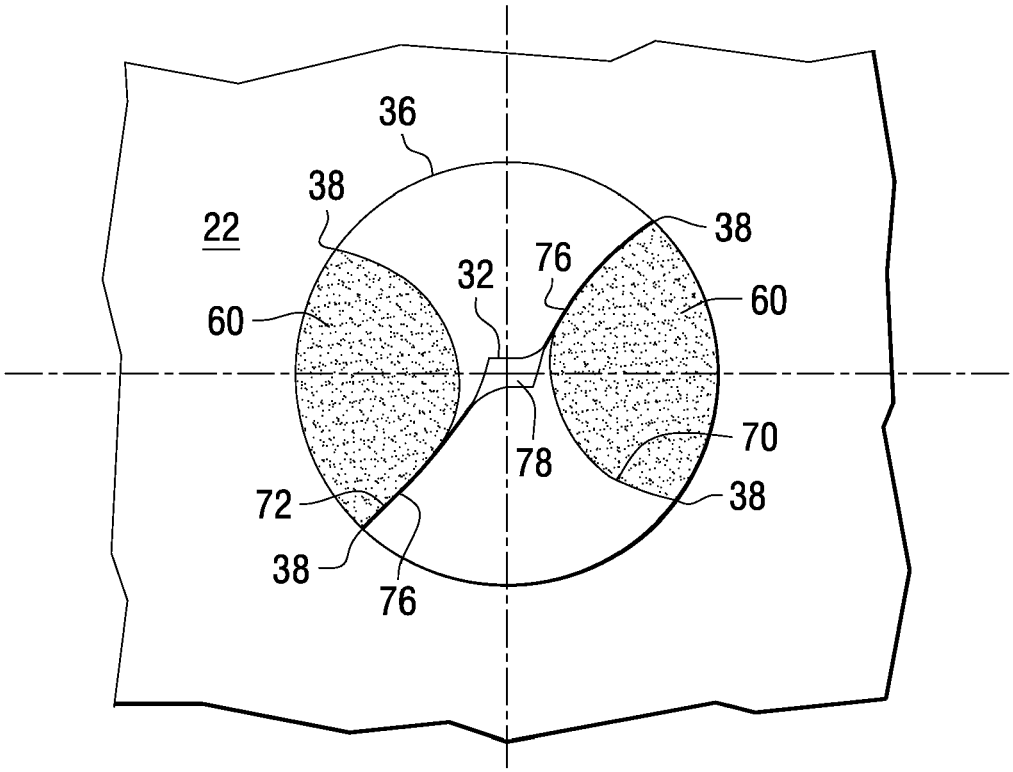
FIG. 4 is a an enlarged view around of the drill tip and tip bushing of FIG. 3 according to one embodiment of the present invention.

Referring now to FIG. 3, a side view of the flute finishing device 10 of FIG. 1 is shown. From this view, the tip end 14 of the polishing device can be seen. Projecting from the containment vessel 12 through the tip bushing is the tip 32 of the drill bit 30. An enlarged view of the tip 32 projecting from the tip bushing 22 is shown in FIG. 4. As shown in FIG. 4, the drill bit may have one or more helical flutes 70, 72, which end at the tip 32 of the drill bit 30. The tip 32 may also have a point 78 with one or more cutting edges 76 extending therefrom.

When the drill bit 30 is rotated, the pressurized abrasive media 60 is forced through the flutes 70, 72, polishing and honing the exterior surface 36 of the drill bit 30, flute edges 38 and flutes 72, 74. The rotation of the drill bit 30 carries the abrasive media 60 toward the tip bore 18 through the flutes, 70, 72 by a screw action. The abrasive media 16 and exits the chamber 13 through the tip bore 18 of the tip bushing 22 and tip collar 26. The positive pressure maintained on the chamber 13 of the containment vessel 12 allows for minute amounts of material to be removed from all exposed surfaces of the helical drill bit and smoothes any irregularities on these surfaces. Upon exiting the chamber 13, the abrasive media 60 has minimal pressure and minimal contact with any cutting edges or cutting corners on the drill bit 30 outside of the tip bushing resulting in no abrasive action on the tip 32 of the drill bit 30 outside of the tip bushing 22. The quality of the resulting polished surfaces of the drill bit 30 are dependent on the viscosity and grit size of the abrasive media 60, the pressure of the media within the vessel, the rotational speed of the drill and the amount of rotation time.

The abrasive media is ideally a rheopectic material having the consistency of putty at room temperature with no pressure applied. In the context of this invention, "rheopectic" defines the property of a composition in which the viscosity increases with time under shear or a suddenly applied stress. Stated another way, this property of the abrasive media is exactly the opposite of "thixotropy". A typical example of such a material is silicone bouncing putty (borosiloxane). As used herein, the term visco-elastic abrasive refers to a material that exhibits both viscous and elastic characteristics when undergoing deformation and uses friction and roughness of texture to smooth or clean a surface.

The media employed in the present apparatus and method may be a semisolid, visco-elastic, rheopectic polymer material which has the consistency of putty. It is important to note that the medium used must have sufficient body at high pressure and low velocity to provide backing for the abrasive particles so that the abrasive particles are pressed against the surface to be treated with sufficient force to obtain the desired result. One suitable medium is silicone putty, i.e., borosiloxane Silicone putty, by strict definition, is a solid. It exhibits, however, many characteristics of a fluid. It is compressible and, therefore, expandable. Under pressure, it becomes less flowable and behaves more like a solid. It conforms exactly to whatever confines it, and thus, ensures abrasion of all surface areas where high shear conditions exist, i.e., the exterior, flutes and/or cutting edges of the drill bit.

The abrasive media 60 may have an apparent viscosity of about 500 Pa·s to about 50,000 Pa·s, for example, 10,000 Pa·s. As used herein, the term "apparent viscosity" refers to the ratio of shear stress to rate of shear of a non-Newtonian fluid, in this case the abrasive media. As mentioned above, the abrasive media has a visco-elastic component which may be silicone-containing polymers such as borosiloxane or other suitable visco-elastic material. The abrasive media 60 also has an abrasive component which may be silicon carbide, aluminum oxide, boron carbide, diamond, CBN, alumina-zirconia and/or garnet. The abrasive component may have a grit size of about 54 microns to about 400 microns, for example, 70 microns. The abrasive component makes a portion of the overall volume of the media which can be expressed as a percent by volume of the abrasive in the abrasive media 60. Percent by volume of abrasive may be about 25% to about 55%, for example, 40%.

The drill 30 of the present invention is rotated within abrasive media 60 while the abrasive media is kept at a positive pressure. It should be appreciated that the drill itself is providing the movement of the abrasive media along the drill before the abrasive media exit through the flutes at the tip end. It follows that, along with the pressure and material properties, the rotational speed of the drill is a key variable in the operation of the device. The rotational speed of the drill bit expressed in rotations per minute (rpm) may be about 30 rpm to about 600 rpm, for example, 60 rpm.

Figure 5:
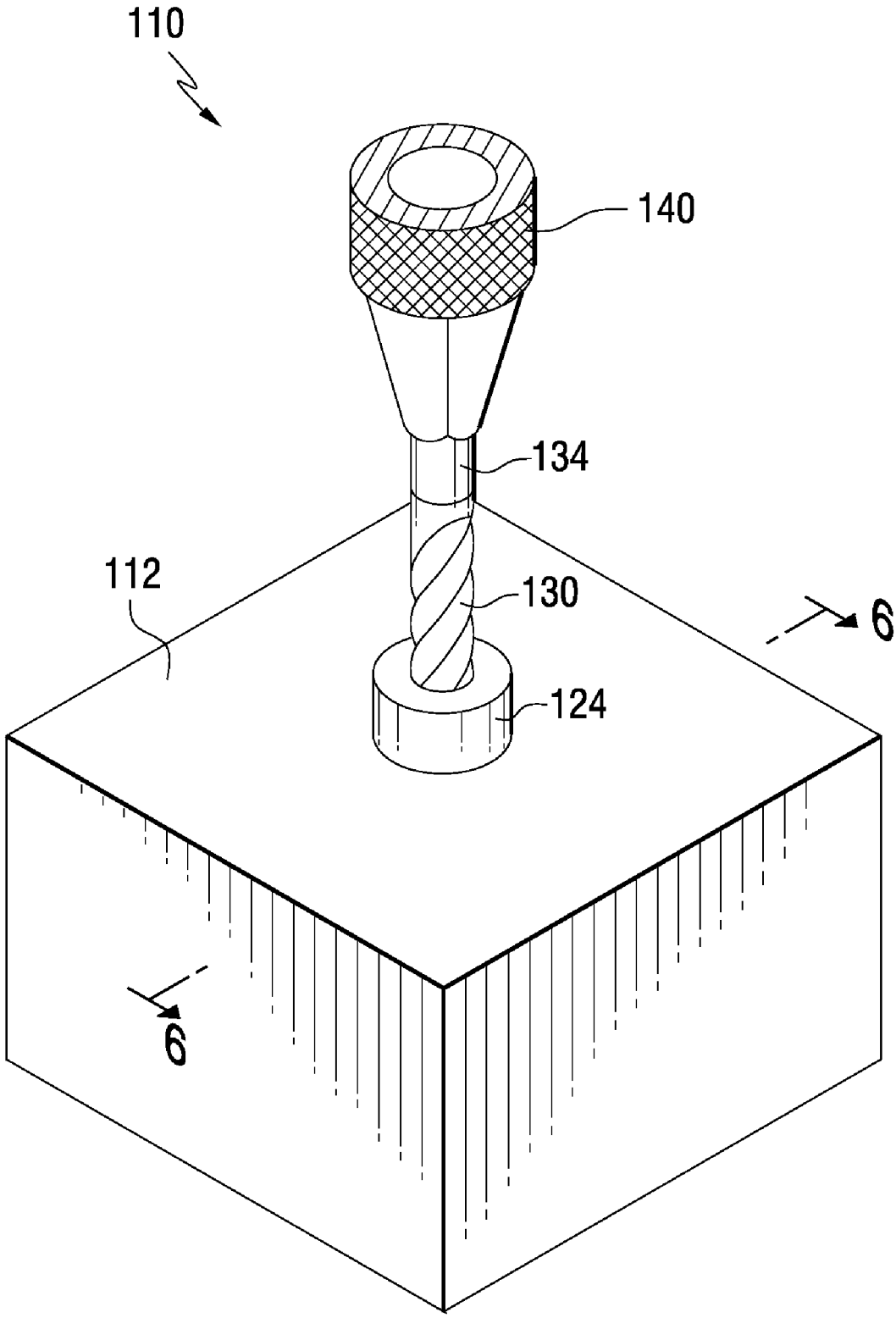
FIG. 5 is an isometric view of a tip finishing device with a drill bit installed and connected to a rotary member according to one embodiment of the present invention.
Figure 6:
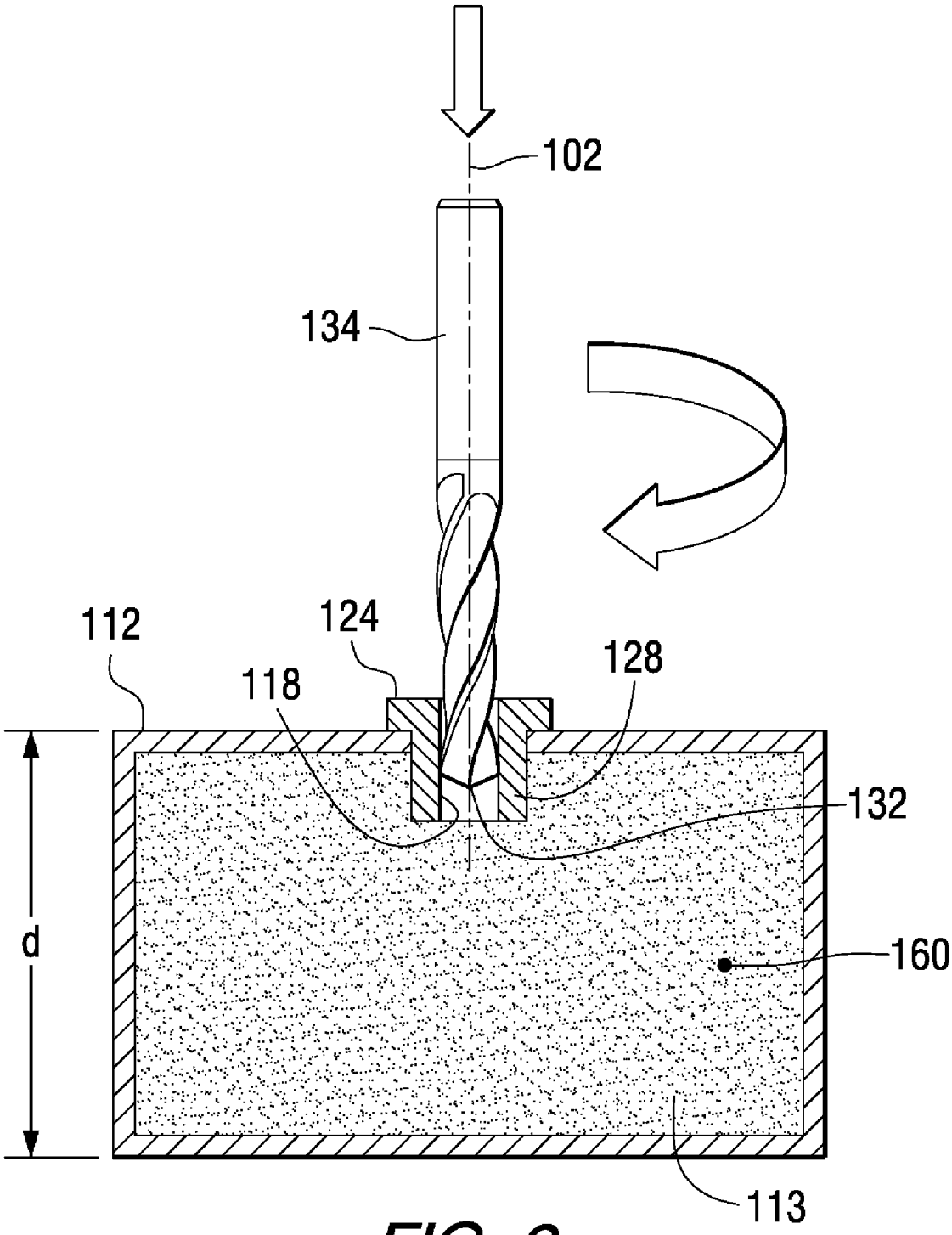
FIG. 6 is a section view of the tip finishing device of FIG. 5 along section line 6-6 with the rotary member removed.

In another embodiment of the present invention shown in FIGS. 5 and 6, an apparatus is shown which provides for honing and polishing of the tip 132 of a drill bit 130. As shown in FIG. 5, a tip finishing device 110 includes a containment vessel 112 having an external guide bushing 124 for receiving a drill bit 130. The shank end 134 of the drill bit 130 is connected to a rotating device 140. The rotating device 140 is capable of rotating the drill bit 30 as well as providing axially movement of the drill bit 30 into and out of the guide bushing 124.

FIG. 6 shows a cross-section of the tip finishing device 110 of FIG. 5 along section line 6-6. As with earlier embodiments, the drill bit 130 is disposed about a rotational axis 102. The feed direction and direction of rotation are illustrated by the arrows in FIG. 6. Inside and aligned with the guide bushing 124 is a guide collar 128. The guide bushing 124 and the guide collar 128 shape a guide bore 118 through which the tip 132 of the drill bit 130 passes. The containment vessel 112 defines an internal chamber 113. The internal chamber 113 is filled with abrasive media 160. As shown in FIG. 6, the containment vessel 112 has no inlet through which the abrasive media 160 may be pressurized. In this embodiment, the abrasive media 160 is of a sufficient viscosity at honing and polishing of the tip 132 of the drill bit 130 is effected without an external pressure source. In other embodiments, it may be desirable to include an inlet through which external pressure is applied to the abrasive media 160.

In the embodiment shown in FIG. 6, the abrasive media 160 has a depth shown as D in FIG. 6 of about 1 inch to about 12 inches, for example 5 inches depending on the size of the drills. Depth, viscosity and grit size of the abrasive media all contribute to the amount of material removed from the drill. Grit size and rotational speed are similar to those described above. Apparent viscosity of the abrasive media 160 for this embodiment for a tip finishing device 110 is typically at the higher end of the range detailed above for the flute finishing device. Feed rate for the drill into the abrasive media is variable and depends mainly on the apparent viscosity, viscoelasticity and rheological dilatancy of the abrasive media 160, i.e., how much does the viscosity of the media increase with increased shear stress.

In this embodiment, the drill bit 30 if fed at a certain feed rate through the guide bushing 124 and guide collar 128. The drill bit 30 passes into the abrasive media of a pre-determined viscosity such that the flow of the media over the cutting edges 172 and chisel point 178 of the drill erodes material from the drill bit 30 producing a very uniform rounding of the cutting edges 172 and chisel point 178. As abrasive media 160 flows up one or more of the flutes, material is removed from the drill bit 130 polishing the surface of one or more flutes. This process is applicable to helical and non-helical style drills.

According to one embodiment of the present invention, a newly ground drill bit 30, 130 may have its outer surface 36, flute edges 38 and flute 72, 74 polished along a central portion of the drill bit 30 by utilizing the flute finishing device 10 of FIG. 1. The same newly ground drill bit may have its tip polished and honed in the tip polishing device of FIG. 5. This process is capable of producing finished, precision drill bits 30 inexpensively and quickly.

Whereas particular embodiments of this invention have been described above for purposes of illustration, it will be evident to those skilled in the art that numerous variations of the details of the present invention may be made without departing from the invention as defined in the appended claims.

The invention claimed is:

1. A drill bit finishing device comprising:

a containment vessel having a first opening and a second opening for receiving a drill bit, wherein the first and second openings each have a bushing between the containment vessel and the drill bit, the containment vessel defining a chamber;

an inlet in fluid communication with the chamber of the containment vessel to feed a pressurized abrasive media into the chamber of the containment vessel, wherein the abrasive media comprises a visco elastic component with an apparent viscosity of about 500 Pa·s to about 50,000 Pa·s; and a rotary member which attaches to a shank end of the drill bit and rotates the drill to displace the abrasive media and finish at least a portion of the drill bit.

2. The drill bit finishing apparatus of claim 1, wherein the abrasive media comprises an abrasive component.

3. The drill bit finishing apparatus of claim 2, wherein the abrasive component has a grit size of about 54 microns to about 400 microns.

4. The drill bit finishing apparatus of claim 2, wherein the abrasive component comprises silicon carbide, aluminum oxide, boron carbide, diamond, CBN, alumina-zirconia and/or garnet.

5. The drill bit finishing apparatus of claim 1, wherein the visco-elastic component comprises borosiloxane.

6. A method of finishing a drill bit comprising the steps of:

providing a containment vessel having a first opening for securing a tip of a drill bit and a second opening for securing a shank of a drill bit, whereby the drill bit passes through an internal chamber of the containment vessel;

inserting the drill bit having at least one flute through the first and second opening of the containment vessel;

filling the internal chamber of the containment vessel with an abrasive media;

pressurizing the abrasive media; and rotating the drill bit to displace the abrasive media thereby finishing the at least one flute of the drill bit.

7. The method of finishing a drill bit of claim 6, wherein the abrasive media comprises a visco-elastic component and an abrasive component.

8. The method of finishing a drill bit of claim 7, wherein the abrasive media has an apparent viscosity of about 500 Pa·s to about 50,000 Pa·s.

9. The method of finishing a drill bit of claim 7, wherein the abrasive component has a grit size of about 54 microns to about 400 microns.

10. The method of finishing a drill bit of claim 7, wherein the abrasive component comprises silicon carbide, aluminum oxide, boron carbide, diamond, CBN, alumina-zirconia and/or garnet.

11. The method of finishing a drill bit of claim 7, wherein the visco-elastic component comprises borosiloxane.

* * * * *